US006013910A

United States Patent [19]

Ferraro et al.

[11] Patent Number: 6,013,910

[45] Date of Patent: Jan. 11, 2000

[54] MICROWAVE OVEN

[76] Inventors: Ana Ferraro, 131 Roxborough Street, East, Toronto, Canada, M4W 1V9; Michael Davis-Burchat, 1754-B Avenue Road, Toronto, Canada, M5M 3Y9

[21] Appl. No.: 09/106,863

[22] Filed: Jun. 30, 1998

[30] Foreign Application Priority Data

Jun. 30, 1997 [CA] Canada ..... 2209321

[51] Int. Cl.[7] ..... H05B 6/64

[52] U.S. Cl. ..... 219/756; 219/734; 219/756

[58] Field of Search ..... 219/725, 729, 219/732, 734, 756, 739

[56] References Cited

U.S. PATENT DOCUMENTS

| | | | |
|---|---|---|---|
| 3,965,325 | 6/1976 | Hirai | 219/756 |
| 4,349,713 | 9/1982 | Marsen | 219/734 |
| 4,490,923 | 1/1985 | Thomas | 34/1 |
| 5,252,797 | 10/1993 | Komatsu | 219/734 |
| 5,369,255 | 11/1994 | Sherer et al. | 219/725 |
| 5,483,044 | 1/1996 | Thorneywork et al. | 219/681 |
| 5,498,856 | 3/1996 | Carlsson | 219/689 |
| 5,601,744 | 2/1997 | Baldwin | 219/689 |
| 5,632,921 | 5/1997 | Risman et al. | 219/756 |
| 5,690,852 | 11/1997 | Saito et al. | 219/734 |

*Primary Examiner*—Tu Ba Hoang
*Assistant Examiner*—Jeffrey Pwu
*Attorney, Agent, or Firm*—John R.S. Orange; Santosh K. Chari; Kevin Pillay

[57] ABSTRACT

A compact microwave oven is provided which has a top-opening, space-efficient housing. An optional container is also provided which is adapted to fit within the housing and to contain the foodstuff to be heated.

8 Claims, 4 Drawing Sheets

MICROWAVE OVEN

BACKGROUND OF THE INVENTION

1. Field of the Invention

The present invention relates to a microwave oven.

2. Description of the Prior Art

Microwave ovens are well known in domestic kitchens. Conventionally, such ovens are generally rectangular with a forward-facing door to permit access to a microwave cavity. Such a door is hinged for movement about a vertical access so that access must be provided to the front of the microwave oven. As a result, such ovens, while very convenient, nevertheless take up a significant amount of space in a kitchen.

The cavity in such a microwave is moreover designed to accommodate plates or bowls so that its overall dimensions are relatively large. Again, this increases the area occupied by the oven.

It is therefore an object of the present invention to provide a microwave oven in which the above disadvantages are obviated or mitigated.

SUMMARY OF THE INVENTION

In general terms, the present invention provides a microwave oven having a housing, a cavity within said housing having a base and side walls to receive a container, a microwave generator to propagate microwave radiation in said cavity and thereby promote heating.

BRIEF DESCRIPTION OF THE DRAWINGS

Embodiments of the invention will now be described by way of example only with reference to the accompanying drawings, in which.

DESCRIPTION OF THE PREFERRED EMBODIMENTS

Figure 1:
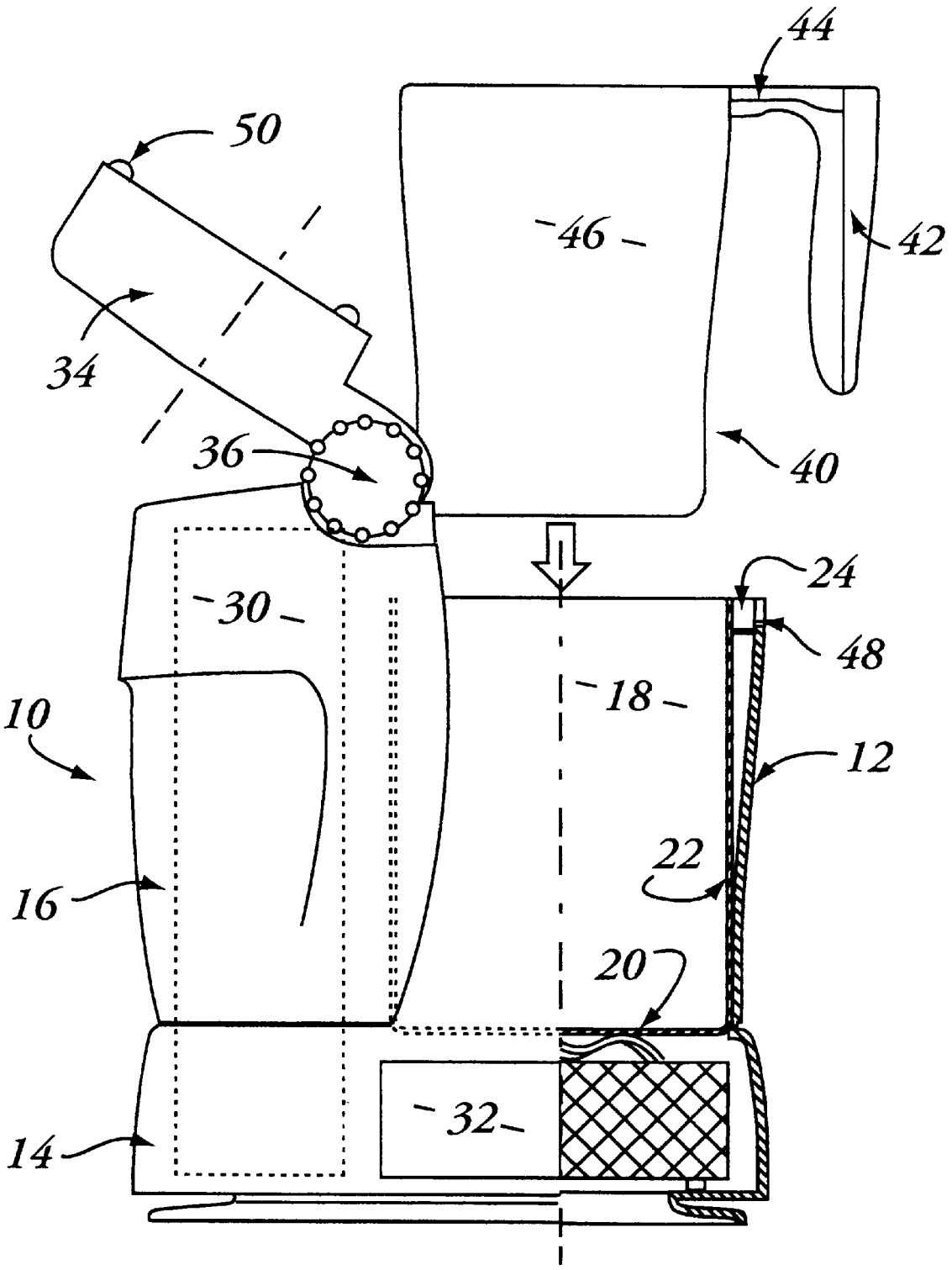
FIG. 1 is a front elevation of a microwave oven in an open position.

Referring therefore to FIG. 1, a microwave oven 10 includes a molded housing 12 incorporating a base 14 and a body 16. The housing 12 is preferably formed from a thin-walled molded plastic and may conveniently be separated at the junction of the base 14 and body 16 for ease of assembly.

A cavity 18 is located within the body 16 and has a base 20 and a cylindrical side wall 22. The base is retained within the body 16 by a collar 24.

Figure 3:
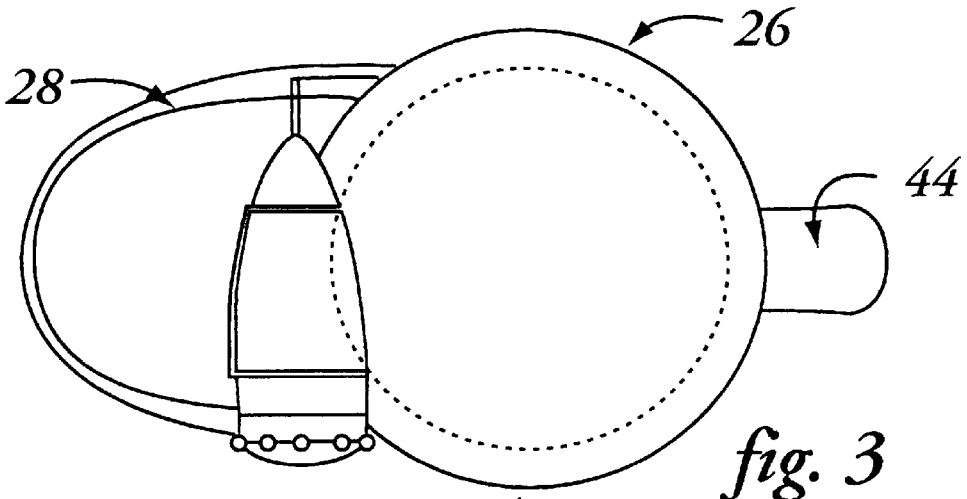
FIG. 3 is a plan view of the oven shown in FIG. 2.

As can best be seen in FIG. 3, the housing 12 has a generally cylindrical portion to receive the cavity 18 and an elliptical extension to one side of the cylindrical portion 26. The elliptical portion 28, as shown in FIG. 1, incorporates electrical components 30 that control the operation of a magnetron 32. The magnetron 32 is located in base 14 beneath the container 18 so as to be aligned with the axis of symmetry of the container 18.

Figure 2:
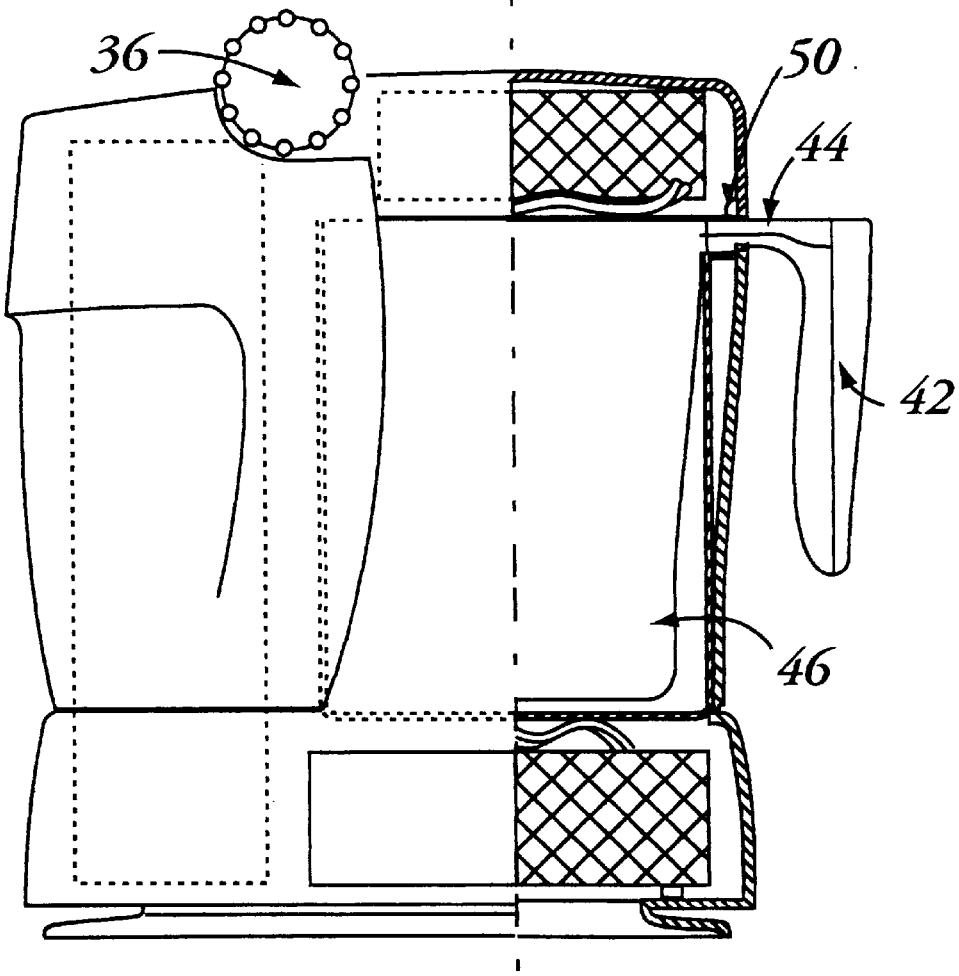
FIG. 2 is a front elevation partly in section of the oven shown in FIG. 1 in a closed position.
Figure 4:
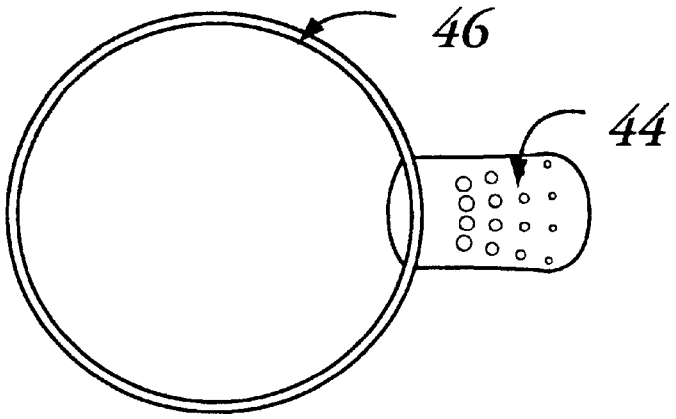
FIG. 4 is a plan view of a container used in the oven of FIG. 2.
Figure 5:
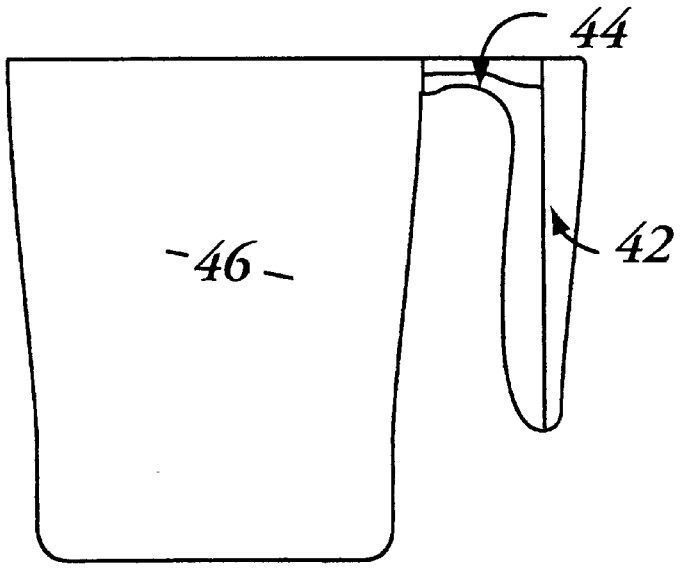
FIG. 5 is a side elevation of the container of FIG. 4.

A lid assembly 34 is pivotally connected to the body 16 by a hinge assembly 36. The lid assembly 34 may pivot about the hinge 36 to cover the cavity 18 as shown in FIG. 2. A magnetron 38 is located within the lid assembly 34 so as to be aligned with the magnetron 32.

The cavity 18 is dimensioned to receive a container 40 having a handle 42. When positioned in the cavity 18, the handle 42, which is connected by a neck 44 to the body 46, projects through a notch 48 formed in the upper edge of the housing 12. The lid assembly 34 includes a seal 50 which snugly encompasses the neck 44 and seals the container within the cavity 18. An interlock is provided between the lid assembly 34 and the control unit 30 to ensure that operation of the magnetrons 32,38 cannot occur unless the lid assembly 34 is sealed with the housing 16.

In operation, the food stuff to be heated is placed into the container 40 which is then located within the cavity 18. The lid assembly 34 is closed and the appropriate controls activated to propagate microwaves from the magnetron within the cavity 18. The food stuff is heated for the required period and the lid 34 may then be opened and the container removed with the use of the handle 42. The food stuff is then in a convenient dispenser for further use and distribution.

It will be noted that the vertical orientation of the cavity with the base 18 and side walls 22 permits a relatively small footprint for the microwave oven 10 while still providing access through the lid assembly 34 located at the top of the cavity 18. Accordingly, the oven may be placed in locations where access to the front is not necessary.

Figure 6:
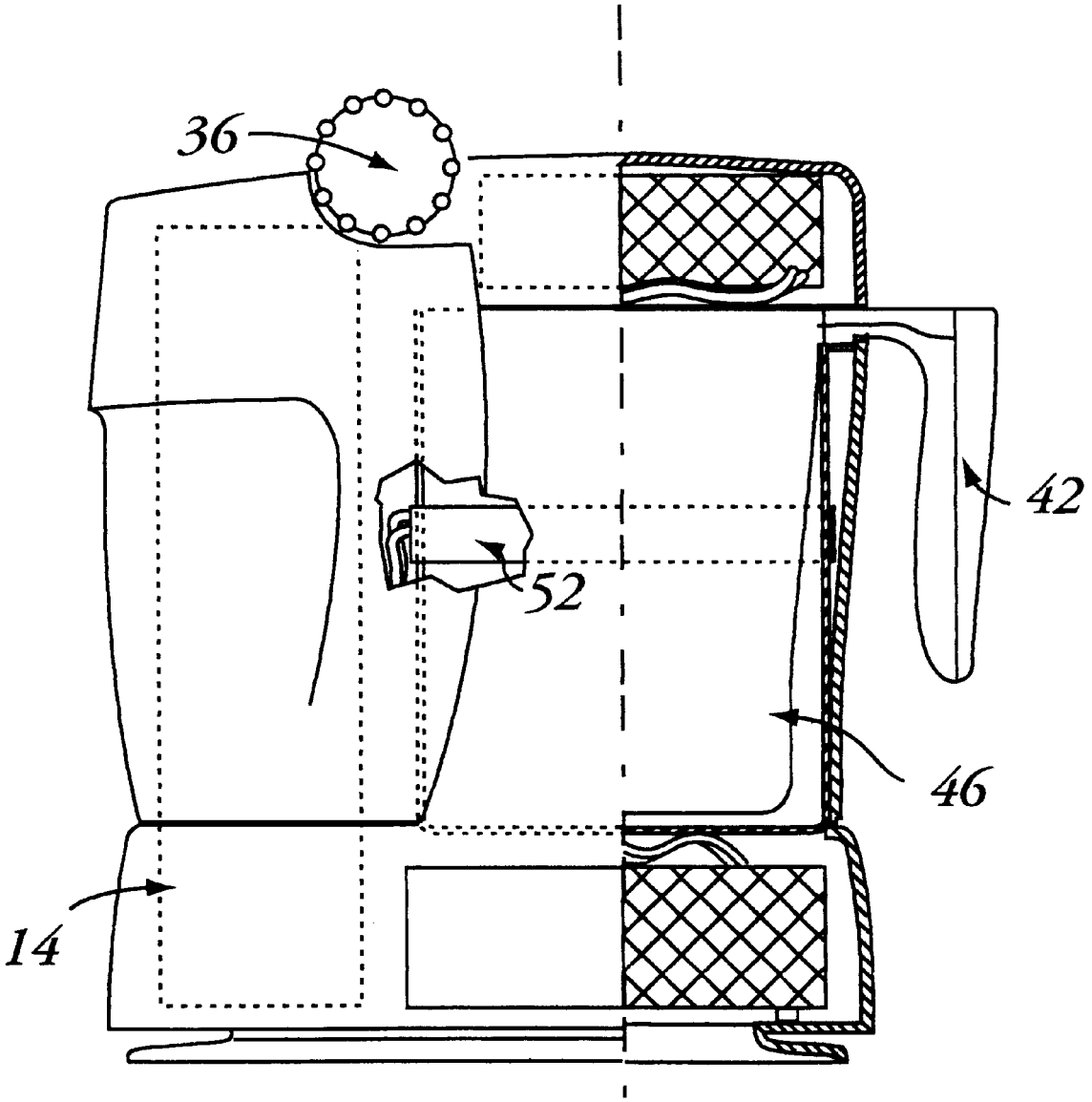
FIG. 6 is an elevation partly in section similar to FIG. 2 of an alternative embodiment of oven.

An alternative embodiment is shown in FIG. 6, in which like components are identified with like reference numerals. In the embodiment of FIG. 6, a cylindrical band 52 extends about the cavity 18 to assist in propagation of the microwave radiation within the cavity.

It will be appreciated that the oven may be utilized without the container 40 to receive directly microwavable containers of a generally cylindrical nature if preferred.

The embodiments of the invention in which an exclusive property or privilege is claimed are defined as follows:

1. A microwave oven having a housing, a cavity within said housing having a base and side walls, a container located in said cavity and having a handle extending across an upper edge of said side walls to permit access from outside said cavity, a microwave generator to propagate microwave radiation in said cavity and thereby promote heating of foodstuffs therein and a lid operably connected to close an upper end of said container with said handle located between said lid and said upper edge of said side wall, said lid being moveable to an open position to permit access to said cavity.

2. The microwave oven according to claim 1, wherein the microwave generator comprises a magnetron located within the base below the cavity so as to align with an axis of symmetry of a container received in the cavity.

3. The microwave oven according to claim 2, further comprising a second magnetron located within the lid so as to be aligned with the magnetron in the base.

4. The microwave oven according to claim 1, wherein the lid is provided with a seal for sealing a container within the cavity.

5. The microwave oven according to claim 4, further comprising an interlock between the lid and the microwave generator for preventing operation of the microwave generator unless the lid is sealed.

6. The microwave oven according to claim 1, wherein the cavity and a portion of the housing are generally cylindrical.

7. The microwave oven according to claim 6, further comprising a cylindrical band extending about the cavity for assisting in propagation of the microwave radiation.

8. The microwave oven according to claim 1, wherein the lid is pivotally connected to the housing.

* * * * *